US008103198B2

(12) United States Patent
Kimura et al.

(10) Patent No.: US 8,103,198 B2
(45) Date of Patent: Jan. 24, 2012

(54) TONER CONTAINER

(75) Inventors: Hisashi Kimura, Kawasaki (JP); Takafumi Amano, Kawasaki (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/940,770

(22) Filed: Nov. 5, 2010

(65) Prior Publication Data

US 2011/0052269 A1 Mar. 3, 2011

Related U.S. Application Data

(60) Continuation of application No. 12/511,584, filed on Jul. 29, 2009, now Pat. No. 7,853,185, which is a division of application No. 11/902,570, filed on Sep. 24, 2007, now Pat. No. 7,583,917, which is a continuation of application No. 11/180,602, filed on Jul. 14, 2005, now Pat. No. 7,302,213.

(30) Foreign Application Priority Data

Jul. 15, 2004 (JP) ..... 2004-208981

(51) Int. Cl.
*G03G 15/08* (2006.01)

(52) U.S. Cl. ..... 399/262

(58) Field of Classification Search ..... 399/262, 399/263, 258

See application file for complete search history.

(56) References Cited

U.S. PATENT DOCUMENTS

| | | | |
|---|---|---|---|
| 5,313,993 | A | 5/1994 | Corby et al. |
| 5,424,816 | A | 6/1995 | Fox et al. |
| 5,432,592 | A | 7/1995 | Watanabe et al. |
| 6,195,516 | B1 | 2/2001 | Ikeda et al. |
| 6,229,976 | B1 | 5/2001 | Kimura |
| 6,256,470 | B1 | 7/2001 | Taniyama et al. |
| 6,266,505 | B1 | 7/2001 | Ban et al. |
| 6,324,370 | B1 | 11/2001 | Isobe et al. |
| 6,438,345 | B1 | 8/2002 | Ban et al. |
| 6,556,800 | B2 | 4/2003 | Matsuda et al. |
| 6,944,417 | B2 | 9/2005 | Yamada et al. |
| 6,978,102 | B2 | 12/2005 | Okamura et al. |
| 7,327,975 | B2 | 2/2008 | Tanaka |
| 2002/0127032 | A1 | 9/2002 | Ban et al. |
| 2003/0063927 | A1 | 4/2003 | Wang et al. |
| 2004/0052553 | A1 | 3/2004 | Isomura et al. |

(Continued)

FOREIGN PATENT DOCUMENTS

JP 04-146466 A 5/1992

(Continued)

OTHER PUBLICATIONS

Machine translation of JP 2000-047466 A dated Jan. 17, 2011.*

(Continued)

*Primary Examiner* — Sophia S Chen
(74) *Attorney, Agent, or Firm* — Foley & Larner LLP

(57) ABSTRACT

A toner container installed in an image forming apparatus includes a toner container main body having a predetermined length and in which toner is accommodated, a discharge port through which the toner is discharged from the toner container main body, a shutter which opens and closes the discharge port, a handle provided on the toner container main body, and a pressed portion provided on the toner container main body and which is pressed by the image forming apparatus to project the handle out from the image forming apparatus.

6 Claims, 13 Drawing Sheets

U.S. PATENT DOCUMENTS

2006/0013620 A1 1/2006 Kimura

FOREIGN PATENT DOCUMENTS

| | | | |
|---|---|---|---|
| JP | 11-073001 | A | 3/1999 |
| JP | 2000-047466 | A | 2/2000 |
| JP | 2000-347493 | A | 12/2000 |
| JP | 2001-228688 | A | 8/2001 |
| JP | 2002-091150 | A | 3/2002 |
| JP | 2003-345117 | A | 12/2003 |
| JP | 2004-021063 | A | 1/2004 |
| JP | 2004-161373 | A | 6/2004 |

OTHER PUBLICATIONS

Hisahi Kimura et al., US PTO Office Action, U.S. Appl. No. 11/902,570, Apr. 7, 2008, 8 pages.

Hisahi Kimura et al., US PTO Office Action, U.S. Appl. No. 11/902,570, Jan. 14, 2009, 5 pages.

Hisahi Kimura et al., US PTO Notice of Allowance, U.S. Appl. No. 11/902,570, Apr. 27, 2009, 4 pages.

* cited by examiner

TONER CONTAINER

CROSS-REFERENCE TO RELATED APPLICATIONS

The present application is a continuation of U.S. application Ser. No. 12/511,584, filed Jul. 29, 2009 which is a divisional of U.S. application Ser. No. 11/902,570, filed Sep. 24, 2007, now U.S. Pat. No. 7,583,917, which is a continuation of U.S. application Ser. No. 11/180,602, filed Jul. 14, 2005, now U.S. Pat. No. 7,302,213, which claims the benefit of priority from the prior Japanese Patent Application No. 2004-208981, filed Jul. 15, 2004; the entire contents of all of which are incorporated herein by reference.

BACKGROUND OF THE INVENTION

1. Field of the Invention

The present invention relates to a toner container used to supply toner to an image forming apparatus.

2. Description of the Related Art

Image forming apparatuses have a toner container used to supply toner to a developing device. The toner container is detachably installed in the image forming apparatus so that when the toner in the toner container is exhausted, a user can replace the toner container. A handle is commonly attached to the toner container so as to facilitate handling of the toner container during replacement (see, for example, Jpn. Pat. Appln. KOKAI Publication No. 2004-21063).

The toner container is provided with a filling port through which the container is filled with toner.

Further, a mixer is always rotated in the toner container to prevent the toner from congealing.

In order to reduce the frequency with which the toner container is replaced, the toner favorably has a larger toner capacity. However, this increases the size of the toner container. An increase in the size and length of the toner container requires the toner container to be pulled quite far out from the image forming apparatus when the container is replaced. However, in pulling out the toner container, it is difficult to handle the container simply by using such a handle as described in the above publication.

Further, with a conventional toner container, if the filling port is located on the axis of the mixer, the mixer interferes with the filling of toner.

Furthermore, the shape of the conventional toner container precludes the toner with which the toner container is filled from being completely used up; the toner container must be replaced although an amount of toner remains in the container.

BRIEF SUMMARY OF THE INVENTION

The present invention is made in view of the above circumstances. It is a first object of the present invention to provide an easy-to-use toner container that can be easily pulled out from an image forming apparatus.

It is a second object of the present invention to provide a toner container that can be easily filled with toner.

It is a third object of the present invention to provide a toner container that can reduce the amount of toner remaining when the toner container is replaced.

To solve the above problems and accomplish the objects, a toner container according to the present invention is configured as described below.

(1) A toner container installed in an image forming apparatus comprises a toner container main body having a predetermined length and in which toner is accommodated, a discharge port through which toner is discharged from the toner container main body, a shutter which opens and closes the discharge port, a handle provided on the toner container main body, and a pressed portion provided on the toner container main body and which is pressed by the image forming apparatus to project the handle out from the image forming apparatus.

(2) In the toner container set forth in (1), the handle projects in a direction crossing a longitudinal direction of the toner container main body.

(3) In the toner container set forth in (1), the shutter closes at least a part of the discharge port in unison with the handle's motion of projecting out from the image forming apparatus.

(4) In the toner container set forth in (1), the shutter opens the discharge port in unison with motion of installing the toner container main body in the image forming apparatus.

(5) A toner container comprises a toner container main body having a predetermined length and in which toner is accommodated, a filling port formed in one end surface of the toner container main body to fill the toner container main body with toner, a mixer which stirs the toner in the toner container main body, a discharge port through which the toner is discharged from the toner container main body, and a screw which conveys the toner from the toner container main body to the discharge port, and the center of the filling port is formed at a position offset from the axis of the mixer.

(6) In the toner container set forth in (5), the toner container main body is divided into two at the position offset from the axis of the mixer, and the filling port is formed closer to the axis of the mixer with respect to a parting surface of the toner container main body.

(7) In the toner container set forth in (6), the toner container main body is divided into two at a position upwardly offset from the axis of the mixer.

(8) A toner container comprises a toner container main body having a predetermined length and including an upper case and a lower case and in which toner is accommodated, a discharge port formed on one side of the lower case in the width direction and through which the toner is discharged from the toner container main body, a screw provided on one side of interior of the toner container main body in a width direction to convey the toner to the discharge port, and a mixer which stirs the toner in the toner container main body, and the upper case comprises a first curvature portion on an inner wall closer to the screw and bent at a first curvature and a second curvature portion on an inner wall opposite to the screw and bent at a second curvature, the second curvature being larger than the first curvature.

(9) The toner container set forth in (8) further comprises a handle provided on the top surface of the upper case and projecting in a direction crossing the longitudinal direction of the upper case.

(10) The toner container according to (9), the handle is formed at substantially the same height from the first curvature portion to the second curvature portion.

(11) A toner container comprises a toner container main body formed along a first direction to accommodate toner, a plate-like member provided on one side of the toner container main body in the first direction and projecting in a second direction perpendicular to the first direction, a positioning member provided on one side of the toner container main body in the first direction and projecting in a third direction perpendicular to the first and second directions, and a discharge port formed on one side of the toner container main body in the first direction to discharge the toner from the toner container main body.

(12) In the toner container set forth in (11), the toner container main body includes an upper case and a lower case, the plate-like member is provided on the top surface of the upper case, and the positioning member is provided on a side of the lower case.

(13) A toner container installed in an image forming apparatus comprises toner accommodating means for accommodating toner, a discharge port through which the toner is discharged from the toner accommodating means, opening and closing means for opening and closing the discharge port, gripping means provided on the toner accommodating means, and pressed means provided on the toner accommodating means and which is pressed by the image forming apparatus to project the gripping means out from the image forming apparatus.

(14) A toner container comprises toner accommodating means having a predetermined length and in which toner is accommodated, a filling port formed on one end surface of the toner accommodating means to fill the toner accommodating means with toner, stirring means for stirring the toner in the toner accommodating means, a discharge port through which the toner is discharged from the toner accommodating means, and conveying means for conveying the toner from the toner accommodating means to the discharge port, and the center of the filling port is provided at a position offset from the axis of the stirring means.

(15) A toner container comprises toner accommodating means having a predetermined length and including an upper case and a lower case and in which toner is accommodated, a discharge port formed on one side of the lower case in a width direction and through which the toner is discharged from the toner accommodating means, conveying means provided on one side of interior of the toner container main body in a width direction to convey the toner to the discharge port, and stirring means for stirring the toner in the toner container main body, and the upper case comprises a first curvature portion on an inner wall closer to the conveying means and bent at a first curvature and a second curvature portion on an inner wall opposite to the conveying means and bent at a second curvature, the second curvature being larger than the first curvature.

(16) A toner container comprises toner accommodating means formed along a first direction to accommodate toner, projecting means provided on one side of the toner accommodating means in the first direction and projecting in a second direction perpendicular to the first direction, positioning means provided on one side of the toner accommodating means in the first direction and projecting in a third direction perpendicular to the first and second directions, and discharging means formed on one side of the toner container main body in the first direction to discharge toner from the toner container main body.

According to the present invention, the toner container can be easily pulled out from the image forming apparatus. Consequently, the toner container can be easily handled when being replaced. Moreover, the present invention can reduce the amount of toner remaining when the toner is replaced.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Description will be given of embodiments for carrying out the present invention.

First, with reference to FIG. 1, description will be given of the internal structure of an electrophotographic copier according to an embodiment of the present invention.

Figure 1:
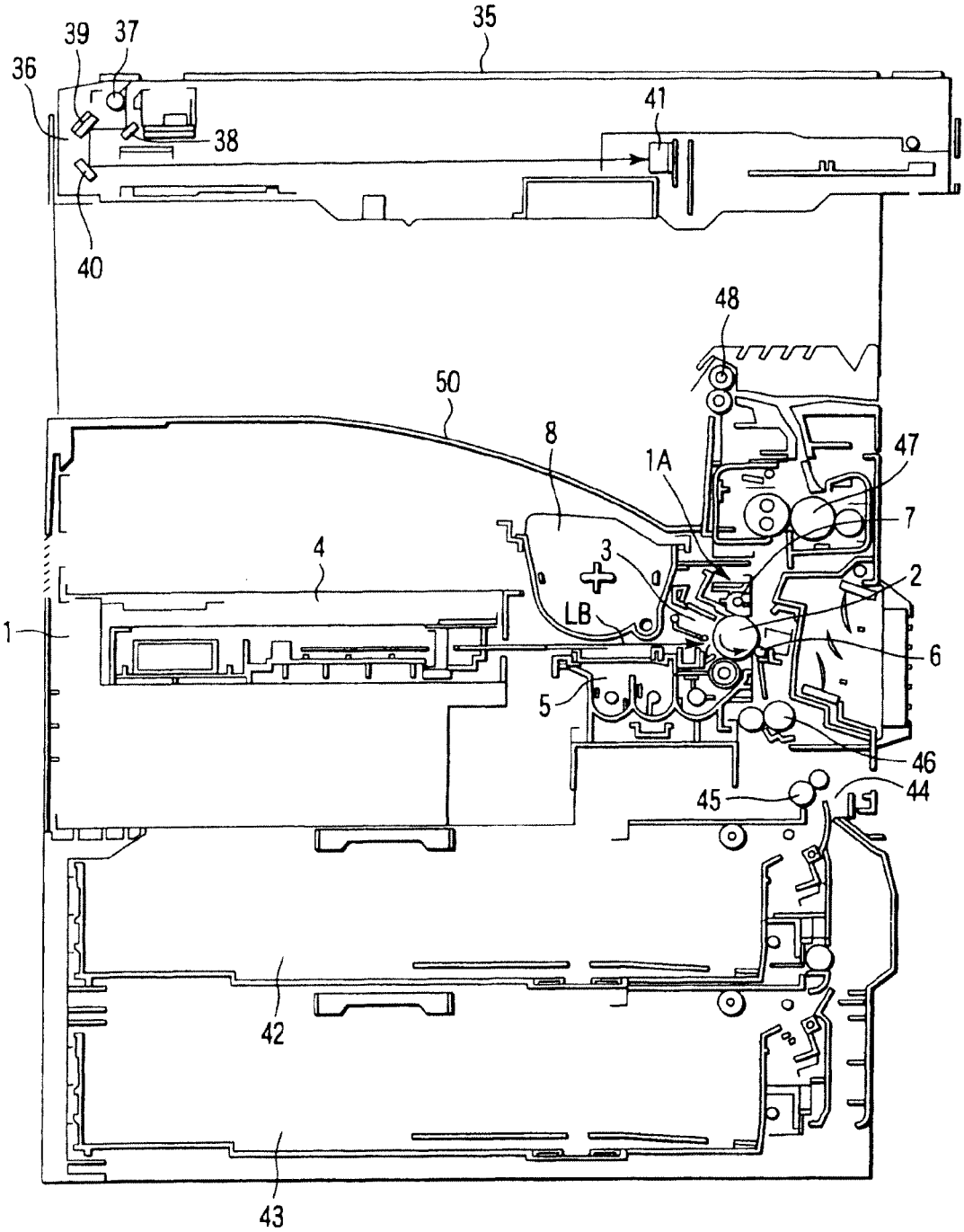
FIG. 1 is a schematic diagram showing the internal structure of an electrophotographic copier according to an embodiment of the present invention.
Figure 2:
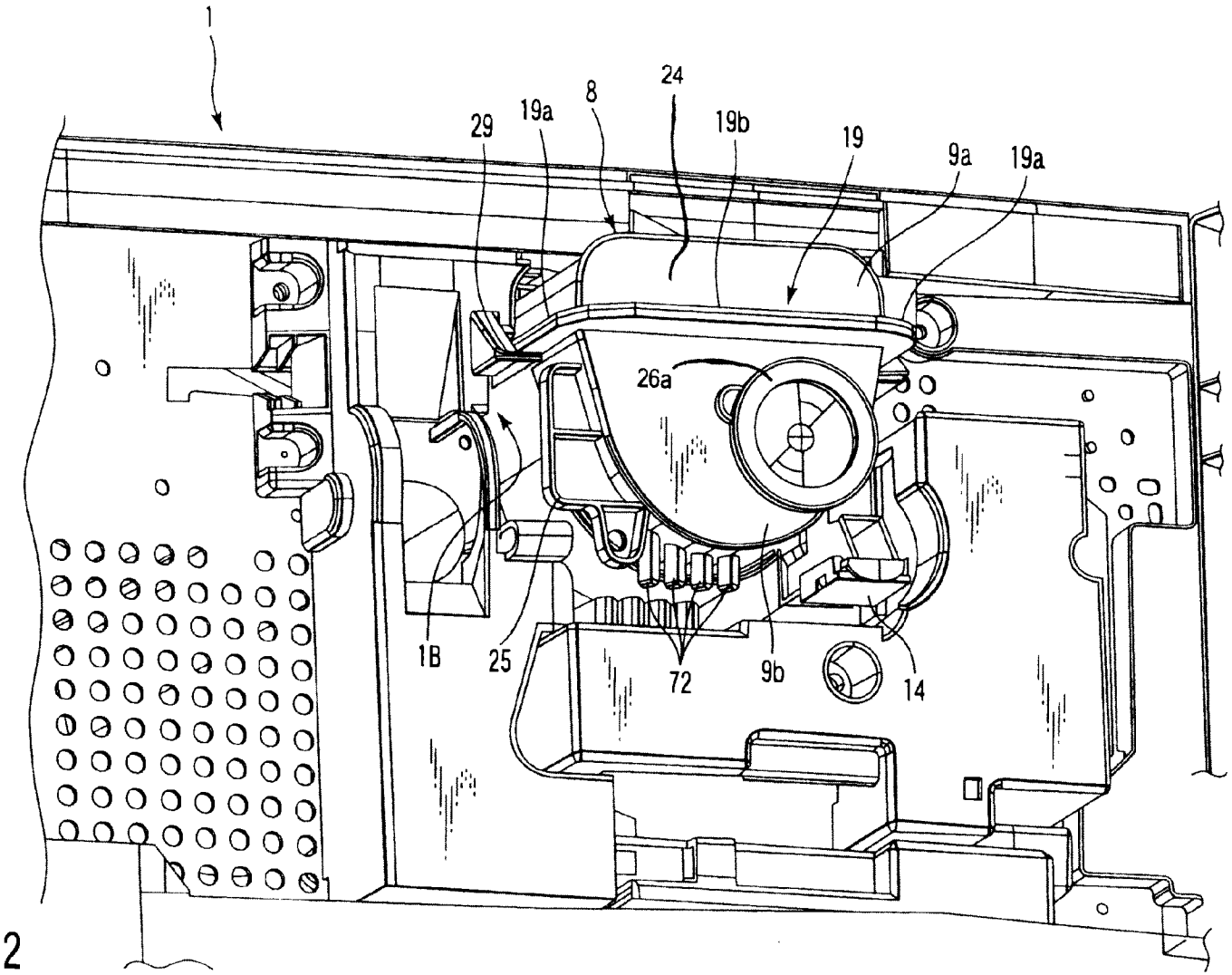
FIG. 2 is an enlarged perspective view showing an essential part of a copier main body according to the embodiment.

FIG. 1 is a schematic diagram showing the internal structure of the electrophotographic copier according to an embodiment of the present invention. FIG. 2 is an enlarged perspective view showing an essential part of a copier main body 1 according to the embodiment.

As shown in FIGS. 1 and 2, the electrophotographic copier has the copier main body 1 (image forming apparatus), having an image forming section 1A provided on one side of the interior of the center of the copier main body 1. The image forming section 1A comprises a photosensitive drum 2 that can rotate in a direction shown by an arrow in the figures. The following components are disposed around the photosensitive drum 2 along the rotating direction of the photosensitive drum 2 in the following order: a charger 3 that charges the surface of the photosensitive drum 2, a laser unit 4 that forms an electrostatic latent image on the surface of the photosensitive drum 2, a developing device 5 that develops the electrostatic latent image on the photosensitive drum 2 using toner, a transferring roller 6 that transfers the toner image on the photosensitive drum 2 to a sheet, and a cleaning device 7 that removes remaining toner from the photosensitive drum 2.

The developing device 5 accommodates a two-component developer consisting of a carrier and toner. A toner cartridge 8 (toner container) is disposed above the developing device 5 to supply toner to the developing device 5. A user replaces the toner cartridge 8. The toner cartridge 8 is inserted from a coupling member 12 (described later) and installed in an accommodating section 1B in the copier main body 1. The toner cartridge 8 is an important point of the present invention and will thus be described later in detail.

A copy board 35 is provided on a top surface of the copier main body 1. A scanner 36 is provided below the copy board 35 to expose a document on the copy board 35. The scanner 36 comprises a light source 37 that irradiates the document with light, a first reflecting mirror 38 that reflects the light reflected by the document, in a predetermined direction, a second and third reflecting mirrors 39 and 40 that sequentially reflect the light reflected by the first reflecting mirror 38, and a light receiving element 41 that receives the light reflected by the third reflecting mirror 40.

A plurality of sheet feeding cassettes 42 and 43 are provided at the bottom of the interior of the copier main body 1. Sheets from the sheet feeding cassettes 42 and 43 are conveyed upward via a conveying system 44. The conveying system 44 is provided with a conveying roller pair 45, a registration roller pair 46, an image transferring section, a fixing roller pair 47, and a sheet discharging roller pair 48.

During image formation, the light source 37 irradiates a document on the copy board 35 with light. The light is reflected by the document and received by the receiving element 41 via the first to third reflecting mirrors 38 to 40 to read a document image. On the basis of the red information, the surface of the photosensitive drum 2 is irradiated with laser light LB from the laser unit 4. The surface of the photosensitive drum 2 is charged to a negative polarity by a charger 3. The photosensitive drum 2 is exposed to the laser light LB applied by the laser unit 4. Thus, in an area of the photosensitive drum 2 which corresponds to an image part on the document, the surface potential of the photosensitive drum 2 becomes close to zero according to the density of the image. As a result, an electrostatic latent image is formed. The electrostatic latent image is placed opposite the developing device 5 by rotating the photosensitive drum 2. At this position, the latent image adsorbs toner supplied via the carrier to become a visible image.

A sheet taken out of the sheet feeding cassette 42 or 43 has already been conveyed through the conveying system 44 and fed into the image transferring section between the transferring roller 6 and the photosensitive drum 2. Thus, the visible image on the photosensitive drum 2 is transferred to the sheet charged to a positive polarity.

The sheet to which the image has been transferred is conveyed to the fixing roller pair 47 and then heated and pressed to fix the image to the sheet. Then, the sheet to which the image has been fixed is discharged onto a sheet discharging tray 50 via the sheet discharging pair 48.

On the other hand, an amount of toner remains on the surface of the photosensitive drum 2 without being transferred by the image transferring section to the sheet. This toner is removed by the cleaning device 7 and then returned to the developing device 5 for reuse. Further, when the toner in the developing device 5 is consumed for development, toner from the toner cartridge 8 is supplied to the developing device 5.

Now, with reference to FIGS. 3 to 7, a detailed description will be given of the configuration of the toner cartridge 8, which is an important point of the present invention.

Figure 3:
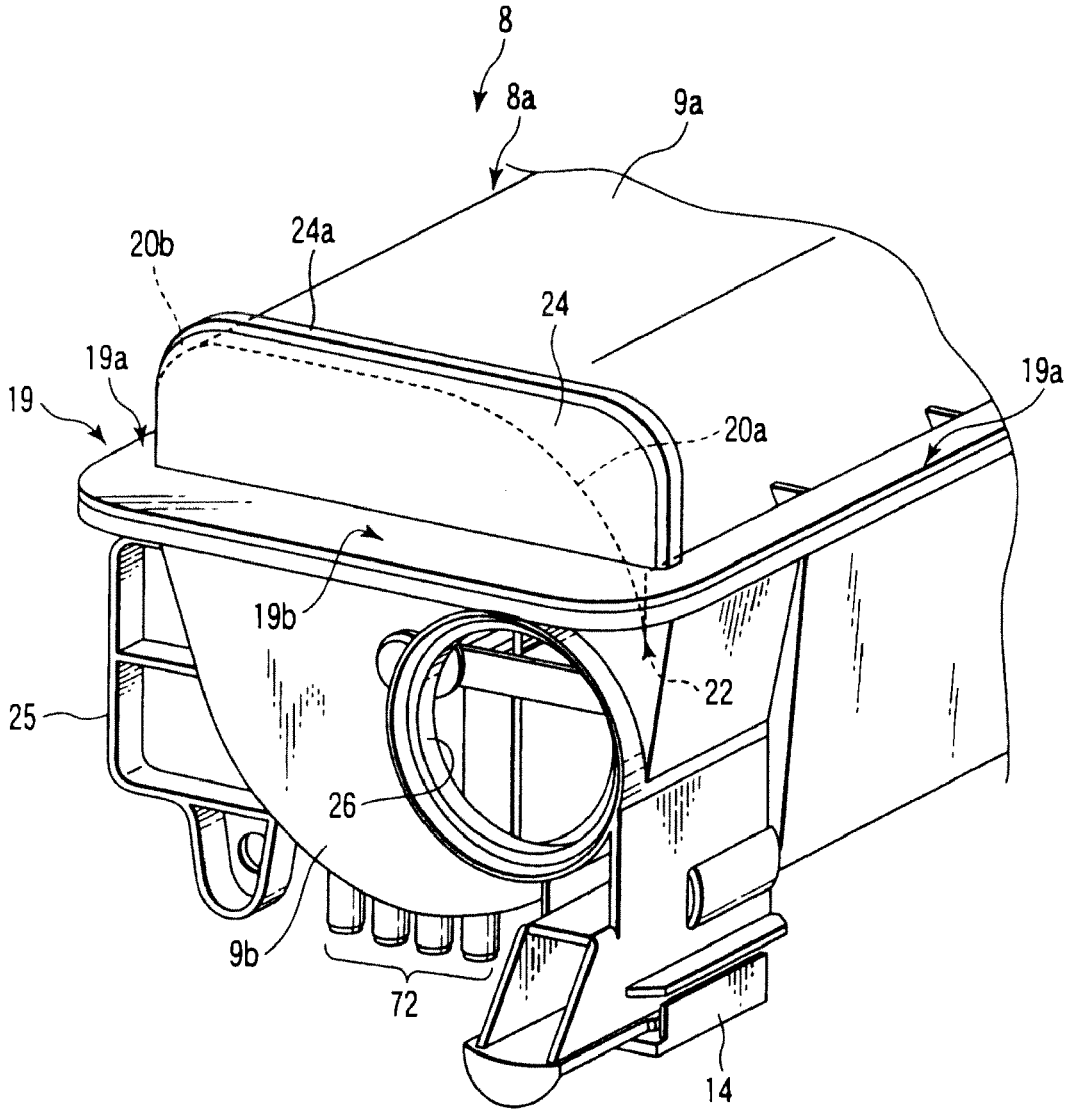
FIG. 3 is a perspective view of a toner cartridge according to the embodiment as viewed from front and above.
Figure 4:
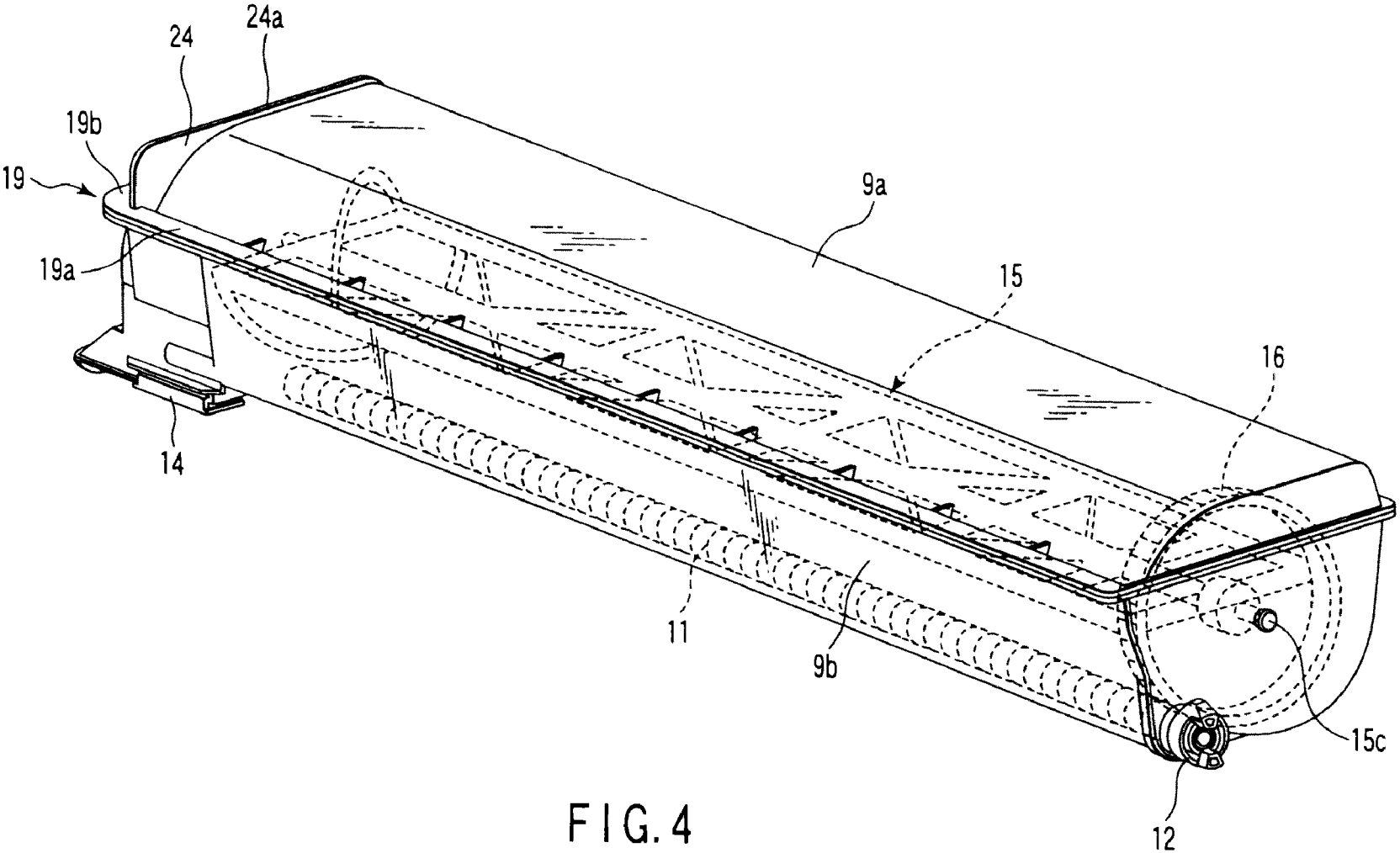
FIG. 4 is a perspective view of a toner cartridge according to the embodiment as viewed from rear and above.
Figure 5:
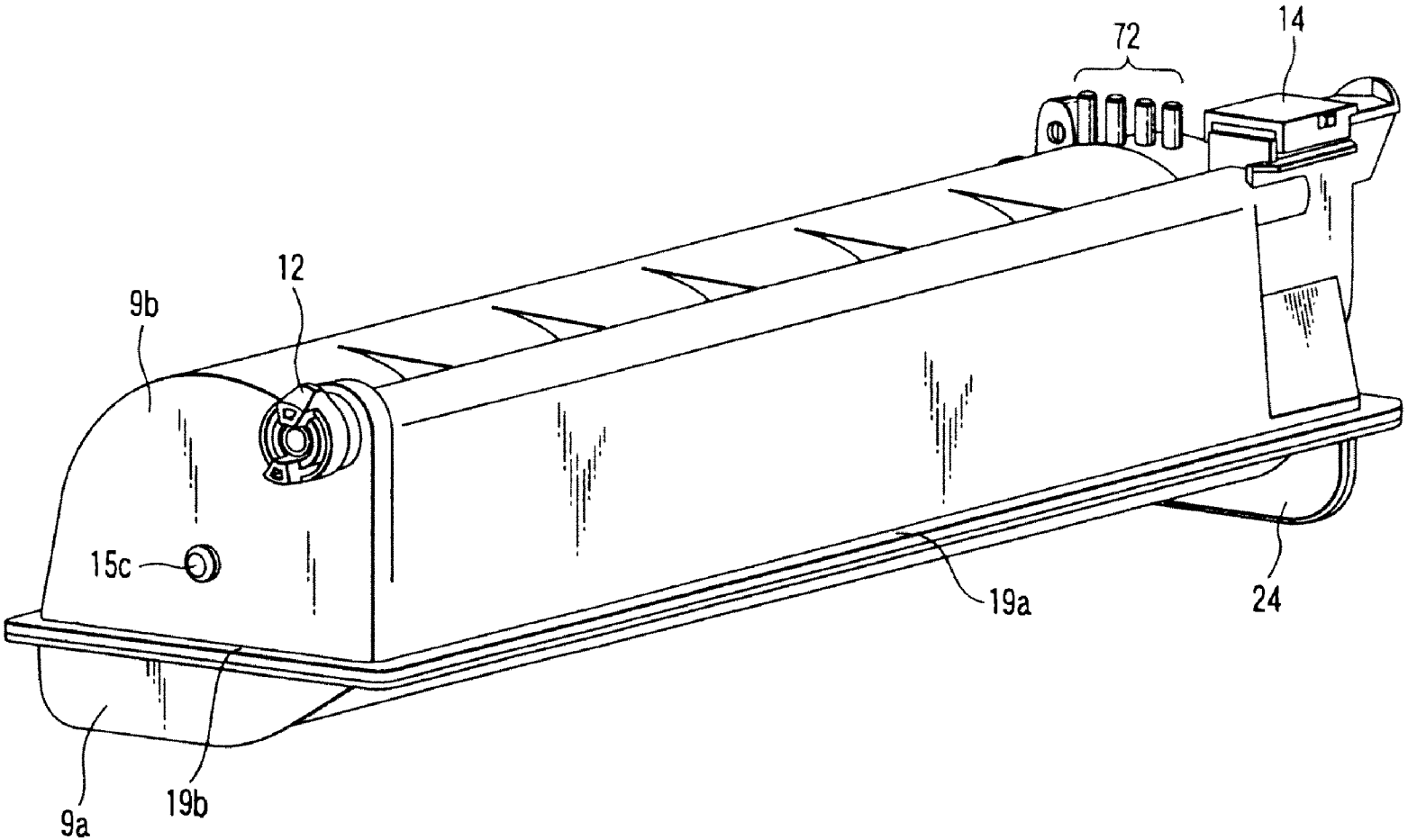
FIG. 5 is a perspective view of a toner cartridge according to the embodiment as viewed from rear and below.
Figure 6:
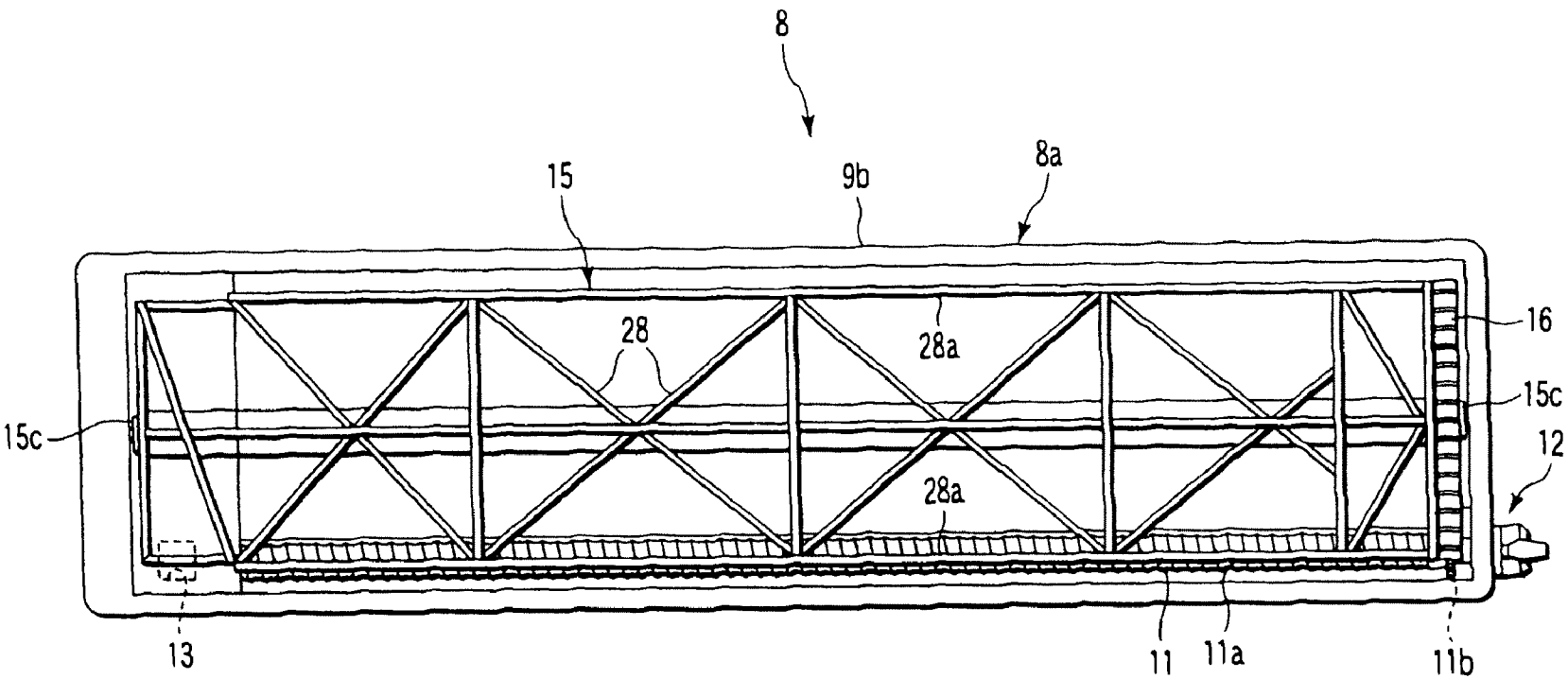
FIG. 6 is a plan view showing the internal configuration of the toner cartridge according to the embodiment.
Figure 7:
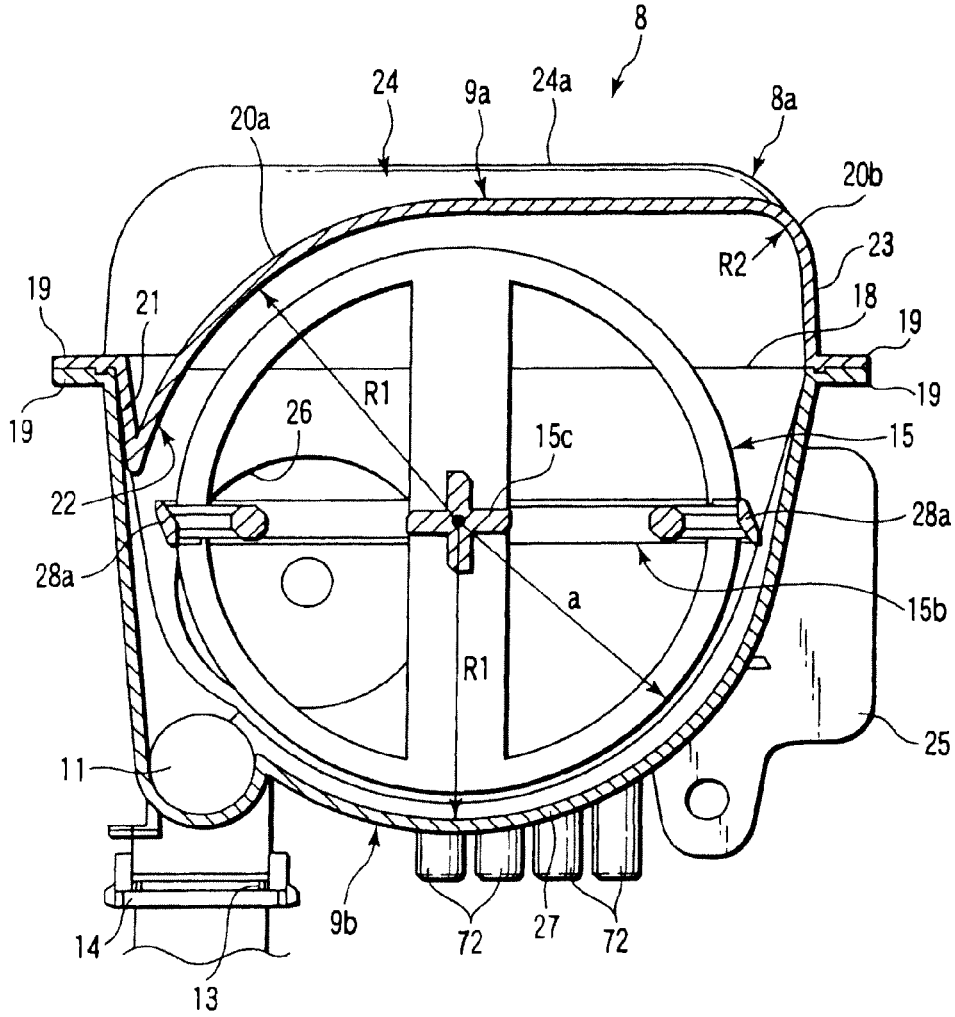
FIG. 7 is a vertical sectional view showing the internal configuration of the toner cartridge according to the embodiment.

FIG. 3 is a perspective view of the toner cartridge 8 according to the embodiment as viewed from the front and above. FIG. 4 is a perspective view of the toner cartridge 8 according to the embodiment as viewed from the rear and above. FIG. 5 is a perspective view of the toner cartridge 8 according to the embodiment as viewed from the rear and below. FIG. 6 is a plan view showing the internal configuration of the toner cartridge 8 according to the embodiment. FIG. 7 is a vertical sectional view showing the internal configuration of the toner cartridge 8 according to the embodiment.

As shown in FIGS. 3 to 7, the toner cartridge 8 has an elongated cartridge main body 8*a* (toner container main body) molded of a material such as resin. The toner cartridge main body 8*a* is composed of an upper case 9*a* and a lower case 9*b* which can be separated from each other in a vertical direction. Powdery toner is accommodated inside the toner cartridge main body 8*a*.

A parting surface 18 between the upper case 9*a* and lower case 9*b* is located above the vertical center of the toner cartridge main body 8*a*. That is, at the opposite surfaces of the toner cartridge main body 8*a* in a longitudinal direction, the lower case 9*b* takes up a larger percentage of the whole toner cartridge main body 8*a* than the upper case 9*a*.

Ribs 19 are provided at the edges of the upper and lower cases 9*a* and 9*b* to join the upper and lower cases 9*a* and 9*b* together. The ribs 19 extend over the entire periphery of the toner cartridge main body 8*a*. Sliding portions 19*a* are composed of parts of the ribs 19 which are located on the opposite sides of the toner cartridge main body 8*a* in its width direction; the sliding portions 19*a* are slidably supported on respective guide surfaces 29 (shown only in FIG. 2) of the copier main body 1. A handle portion 19*b* is composed of a part of the ribs 19 which is located at a front surface of the toner cartridge main body 8*a*; the handle portion 19*b* is gripped by the fingers when the toner cartridge 8 is replaced with a new one.

The upper case 9*a* comprises a first curvature portion 20*a* formed on one side in its width direction and bent at a first curvature $\kappa 1$ and a second curvature portion 20*b* formed on the other side in the width direction and bent at a second curvature $\kappa 2$ larger than the first curvature $\kappa 1$.

In the present embodiment, the radius of curvature R1 (expressed as $1/\kappa 1$ in terms of the curvature) of the first curvature portion 20*a* is about 82 mm. The radius of curvature R2 (expressed as $1/\kappa 2$ in terms of the curvature) of the second curvature portion 20*b* is about 8.2 mm.

The lower end of the first curvature portion 20*a* extends to below the parting surface 18 and is connected to an inner peripheral part of the ribs 19 via a turn-up portion 21. Thus, a sharp portion 22 is formed on one side of the upper case 9*a* in its width direction in a horizontally cutaway view; the sharp portion 22 consists of two resin plates, the first curvature portion 20*a* and the turn-up portion 21. On the other hand, the lower end of the second curvature portion 20*b* is connected to the inner peripheral part of the ribs 19 via a vertical portion 23.

A plate-like handle 24 (plate-like member) is provided in a front surface side of the top surface of the upper case 9*a* so as to extend a substantially vertical direction; the fingers are placed on the handle 24 in order to pull out the toner cartridge 8 from the housing section 1B of the copier main body. The handle 24 is formed over the entire upper case 9*a* in its width direction and has an upper end 24*a* constituting a substantially horizontal plane. This allows the toner cartridge 8 to sit stably when placed with its bottom surface up (see FIG. 5).

In the present embodiment, the upper end 24*a* of the handle 24 extends in the horizontal direction. However, the present invention is not limited to this. For example, the upper end 24*a* of the handle 24 may be inclined or provided with concave and convex portions.

On the other hand, the lower case 9*b* is composed of a third curvature portion 27 bent at substantially the same curvature (that is, κ1) as that of the first curvature portion 20*a*.

A discharge port 13 is formed on one side of the bottom of the lower case 9*b* to discharge toner from the toner cartridge main body 8*a* to the developing device 5. The discharge port 13 projects downward from the lower case 9*b*. The discharge port 13 has a shutter 14 movably provided at its lower end to open and close the discharge port 13.

A bar-like screw 11 is provided at the bottom of interior of the lower case 9*b* at a position where it lies opposite the discharge port 13; the screw 11 extends along the longitudinal direction, and is used to convey the toner from the toner cartridge main body 8*a* to the discharge port 13. The longitudinally opposite ends of the screw 11 are rotatably supported by the longitudinally opposite end surfaces of the lower case 9*b*.

One longitudinal end of the screw 11 projects outward from the rear surface of the lower case 9*b*. A first coupling member 12 is provided at a tip portion of the screw 11; the first coupling member 12 is connected to a driving device 30 (described later) in the copier main body 1.

Further, projecting portions 72 are provided in a part of the bottom surface of the lower case 9*b* which is closer to its front surface; the shape and number of the projecting portions 72 vary depending on the sales territory.

A mixer 15 is provided inside the toner cartridge main body 8*a* along the longitudinal direction to stir the toner in the toner cartridge main body 8*a*. A shaft member 15*c* (described later) of the mixer 15 is rotatably supported in bearing portions 71 (shown only in FIG. 10) provided at the longitudinally opposite end surfaces of the lower case 9*b*. The axis of the shaft member 15*c* is adjusted so as to substantially coincide with the center of radius of the first and third curvature portions 20*a* and 27.

A mixer gear 16 is provided at one end of the shaft member 15*c* of the mixer 15 in the longitudinal direction. The mixer gear 16 engages with a screw gear 11*b* provided at one end of the screw 11 in the longitudinal direction. Rotation of the screw 11 rotates the mixer 15 in unison.

Further, a pressed plate 25 (positioning member) is provided on the outer surface of the other side of the lower case 9*b* in its width direction. When the toner cartridge 8 is pulled out from the housing section 1B of the copier main body 1, a lever 60 in the copier main body presses the pressed plate 25.

A circular filling port 26 is formed in the front surface of the lower case 9*b* offset from the axis of the mixer 15 to fill the toner cartridge main body 8*a* with toner. The filling port 26 is tightly closed with a cap 26*a*, as shown in FIG. 2. An operation of filling the toner cartridge main body 8*a* is performed during a process of manufacturing the toner cartridge 8 and not by the user.

Now, the configuration of the screw 11 will be described with reference to FIG. 8.

Figure 8:
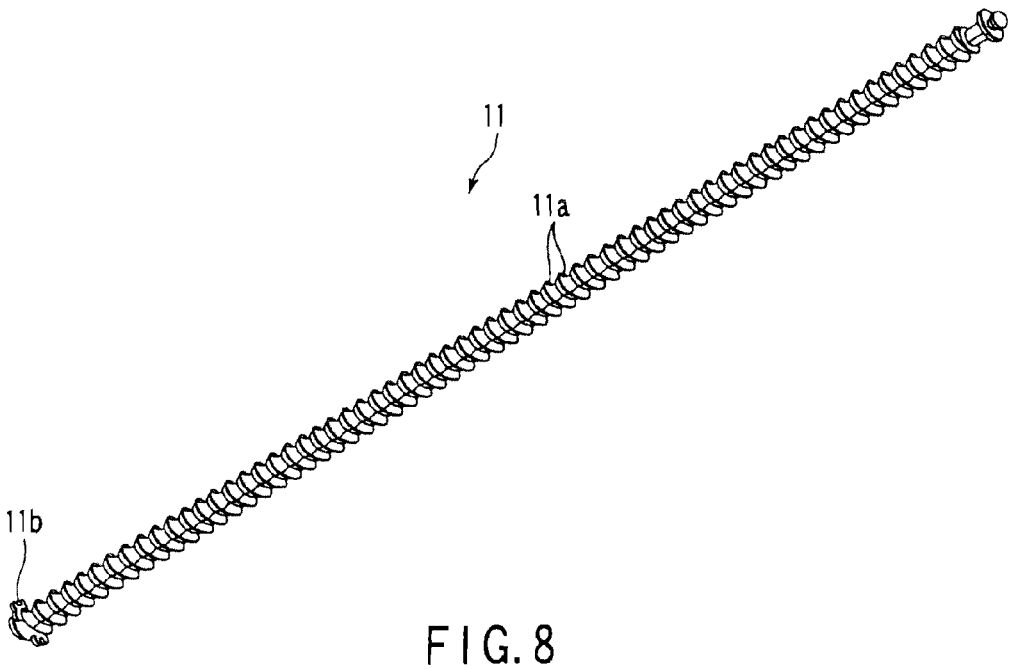
FIG. 8 is a perspective view of a screw according to the embodiment.

FIG. 8 is a perspective view of the screw 11 according to the embodiment.

As shown in FIG. 8, a plurality of spiral blade portions 11*a* (described later) are formed on the outer peripheral surface of the screw. These blade portions 11*a* are sharpened toward the outside of the screw 11 in its radial direction.

That is, each of the blade portions 11*a* has a part formed on its tip surface and parallel to the inner surface of the lower case 9*b* and which has a reduced area. Thus, even if the screw 11 is warped to bring the tip surface of the blade 11*a* into contact with the lower case 9*b*, the contact area is minimized. This suppresses toner clamp that may result from toner sandwiched between the blade portions 11*a* and the lower case 9*b*.

Now, the configuration of the mixer 15 will be described with reference to FIG. 9.

Figure 9:
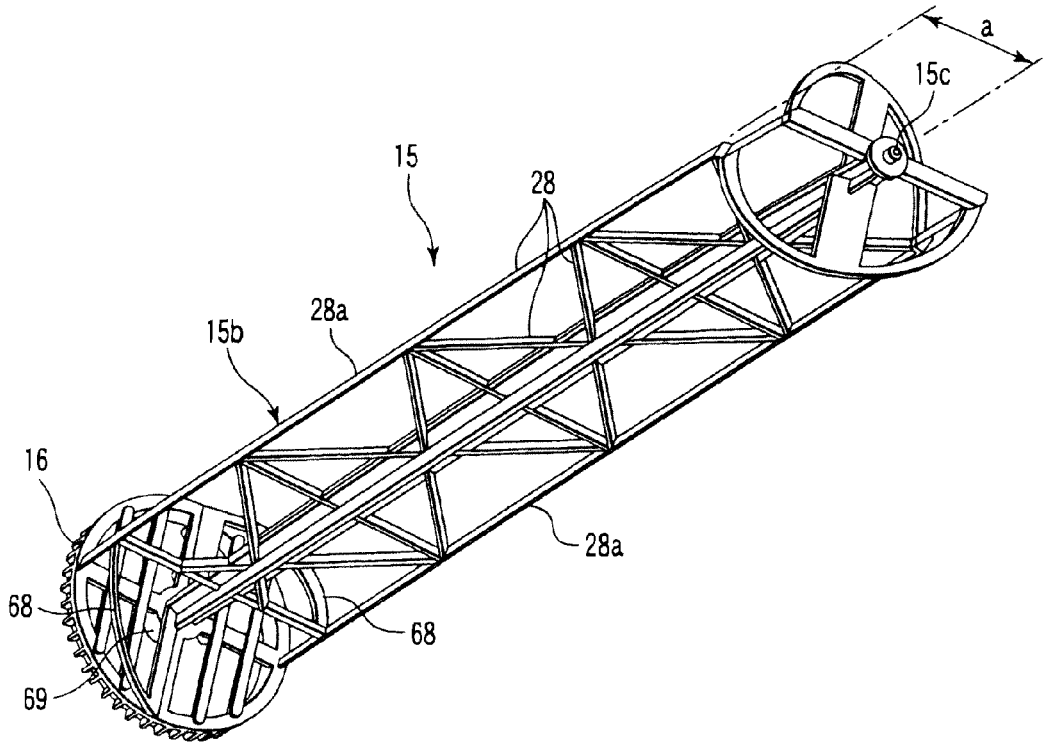
FIG. 9 is a perspective view of a mixer according to the embodiment.

FIG. 9 is a perspective view of the mixer 15 according to the embodiment.

As shown in FIG. 9, the mixer 15 comprises the round bar-like shaft member 15*c*. A plate-like truss structure portion 15*b* is provided around an outer peripheral portion of the shaft member 15*c*; the plate-like truss structure portion 15*b* is composed of a combination of a plurality of thin bar-like members 28.

The radius of curvature R1 (expressed as 1/κ1) of the first curvature portion 20*a* is slightly larger than the length a to the opposite ends of the plate-like truss structure portion 15*b* in its width direction as measured from the center of the shaft member 15*c* of the mixer 15.

Thus, when the mixer 15 is rotated in the toner cartridge main body 8*a*, bar-like members 28*a* provided at the opposite ends of the plate-like truss structure portion 15*b* move along the inner peripheral surface of the first curvature portion 20*a* so as to graze this inner peripheral surface. This allows the toner present near the inner peripheral surface of the first curvature portion 20*a* to be appropriately scraped out.

Of the plurality of bar-like members 28, those bar-like members 28*a* disposed at the opposite ends of the plate-like truss structure portion 15*b* in its width direction have a sharp part located at the leading end of the mixer 15 in a rotating direction. These parts reduce a resistance force acting on the plate-like truss structure portion 15*b* when the mixer 15 is rotated.

Further, a spiral conveying blade 68 is provided at one end of the mixer 15 in its longitudinal direction to quickly remove toner from the vicinity of the area in which the mixer gear 16 engages with the screw gear 11*b*.

Now, the mixer 15 and the bearing portion 71 will be described with reference to FIG. 10.

Figure 10:
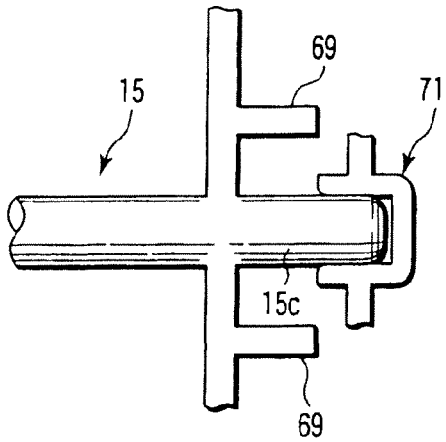
FIG. 10 is a schematic diagram showing the mixer and a bearing portion according to the embodiment.

FIG. 10 is a schematic diagram showing the mixer 15 and bearing portion 71 according to the embodiment.

As shown in FIG. 10, a wall portion 69 is provided around the shaft member 15*c* of the mixer 15 to prevent the toner in the toner cartridge main body 8*a* from advancing between the shaft member 15*c* and the bearing portion 71. This suppresses toner clamp that may occur when the toner in the toner cartridge main body 8*a* is sandwiched between the shaft member 15*c* and the bearing portion 71.

Now, the configuration of the first coupling member 12 will be described in detail with reference to FIG. 11.

Figure 11:
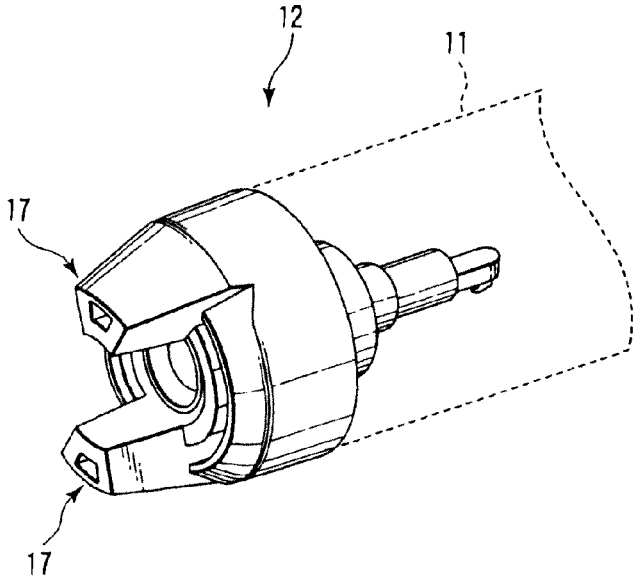
FIG. 11 is a perspective view of a first coupling member according to the embodiment.

FIG. 11 is a perspective view of the first coupling member 12 according to the embodiment.

As shown in FIG. 11, the first coupling member 12 is formed like a flat cylinder. One end of the screw 11 in the longitudinal direction is fixed to a central portion of the first coupling member 12 in its radial direction. Projecting portions 17 are provided on an end surface of the first coupling member 12 which is opposite the toner cartridge main body 8*a*, so as to separate from each other by 180° in the circumferential direction of the first coupling member 12; the projecting portions 17 engage with the driving device (described later) 30, provided in the copier main body 1.

Of the faces constituting each of the projecting portions 17, one located on the outside of the first coupling member 12 in its radial direction has an axis common as that of the first coupling member 12. This face consists of a part of a conical surface tapered from the position closest to the toner cartridge main body 8*a* to the tip of the projecting portion 17.

Now, with reference to FIG. 12, description will be given of the relationship between the first coupling member 12 and the second coupling member 31.

Figure 12:
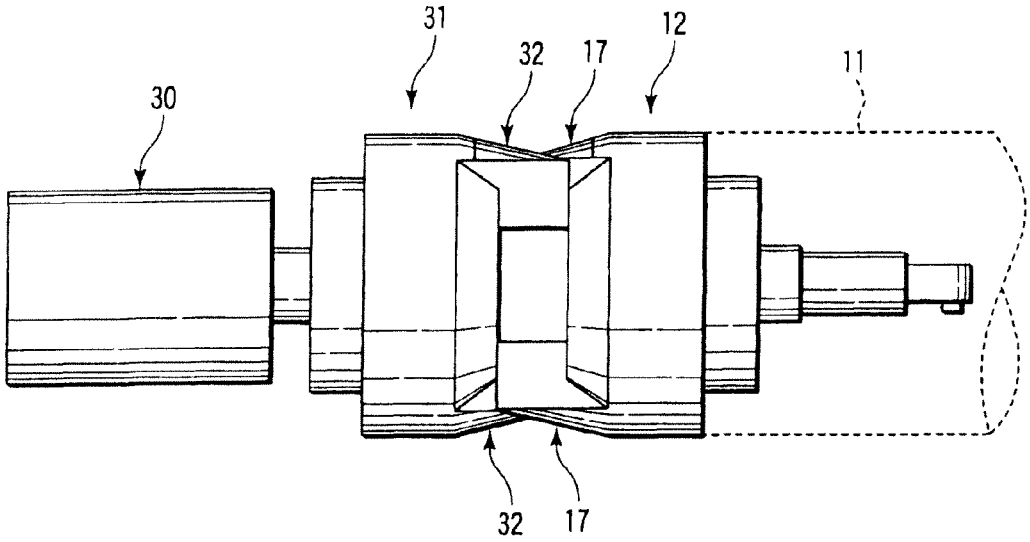
FIG. 12 is a schematic diagram showing the relationship between the first coupling member and a second coupling member according to the embodiment.

FIG. 12 is a schematic diagram showing the relationship between the first coupling member 12 and the second coupling member 31 according to the embodiment.

As shown in FIG. 12, the driving device 30 (driving section) is provided at a position in the copier main body 1 which corresponds to the first coupling member 12 when the toner cartridge 8 is inserted and installed in the housing section 1B of the copier main body 1; the driving device 30 is used to rotate the screw 11. The driving device 30 comprises a second coupling member 31 located opposite the first coupling member 12 and having substantially the same shape as that of the first coupling member 12.

The second coupling member 31 has a projecting portion 32 engaged with the projecting portion 17 of the first coupling member 12. Driving the driving device 30 enables the first coupling member 12 to rotate at a predetermined speed.

Now, with reference to FIGS. 13 and 14, description will be given of the relationship between the pressed plate 25 and the lever 60.

Figure 13:
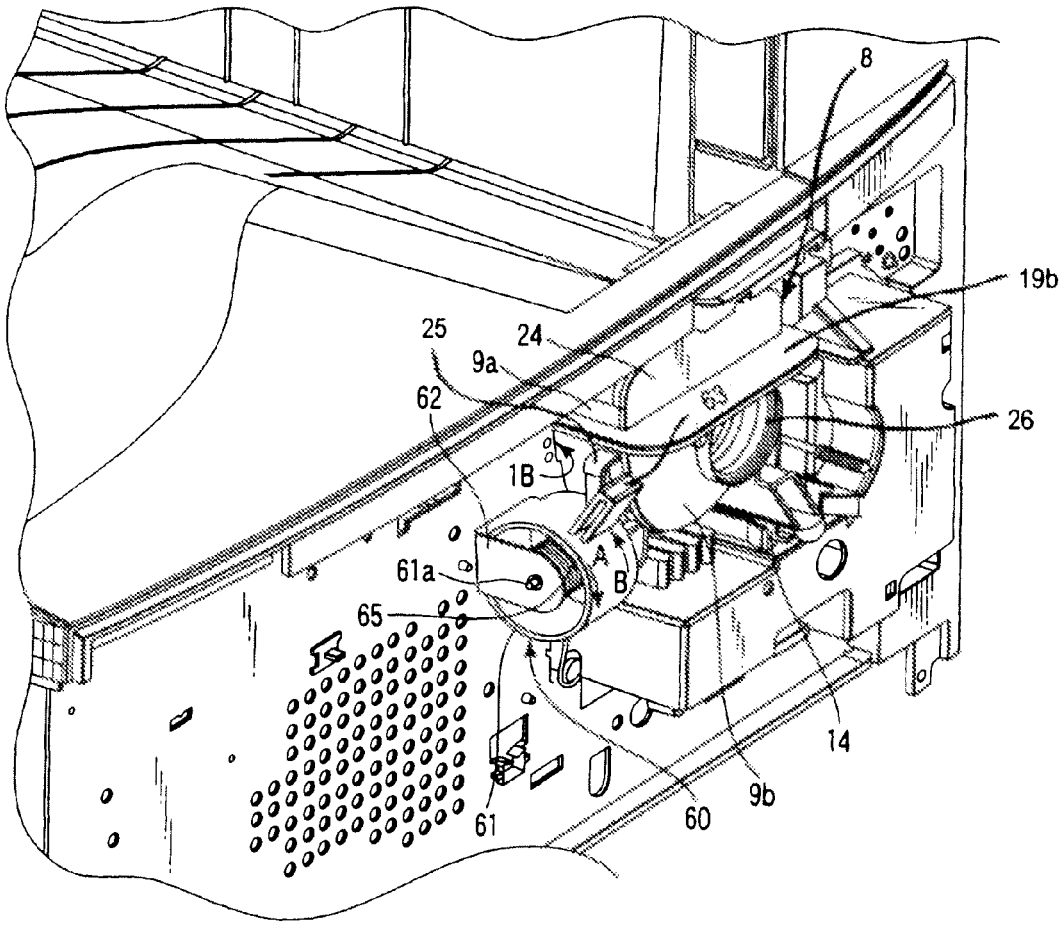
FIG. 13 is a perspective view showing the toner cartridge is completely installed in the copier main body according to the embodiment.

FIG. 13 is a perspective view showing the toner cartridge 8 completely installed in the copier main body 1 according to the embodiment. FIG. 14 is a perspective view showing the handle 24 projected from the copier main body according to the embodiment.

Figure 14:
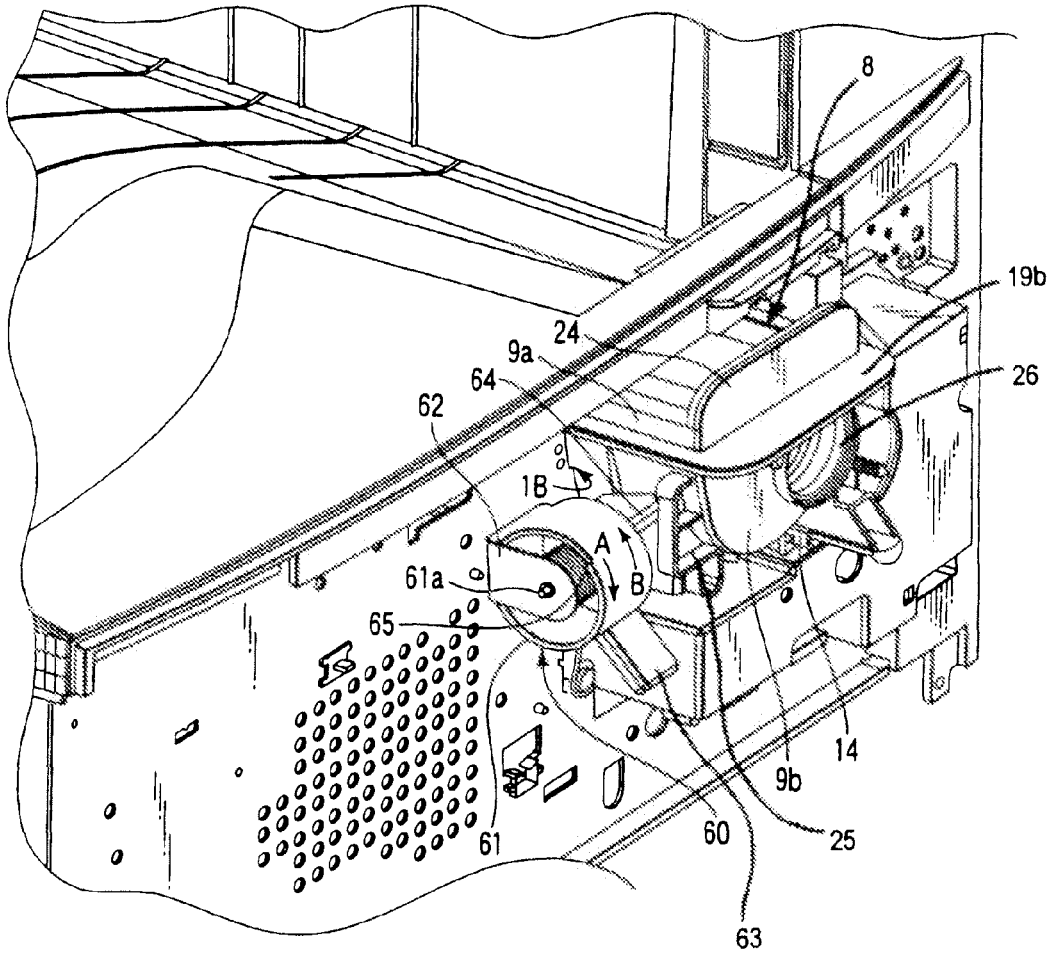
FIG. 14 is a perspective view showing a handle projected from the copier main body according to the embodiment.

As shown in FIGS. 13 and 14, the lever 60 is disposed at a position where it lies opposite the pressed plate 25 when the toner cartridge 8 is inserted and installed in the housing section 1B of the copier main body 1; the lever 60 is used to project the handle 24 out from the copier main body 1.

The lever 60 has a cylindrical rotating member 61 having a shaft member 61*a* rotatably supported by a pair of attaching members 62 fixed to the copier main body 1. A plate-like gripping portion 63 is provided around the outer peripheral surface of the rotating member 61 so as to extend substantially parallel to the shaft member 61*a*; the gripping portion 63 is gripped by fingers. Furthermore, a round bar-like pressing projection 64 is provided on a side of the rotating member 61 which is opposite the toner cartridge 8, to press the pressed plate 25.

The pressing projection 64 is placed offset from the axis of the rotating member 61. When the lever 60 is rotated in the direction of arrow A, the pressing projection 64 presses the pressed plate 25 to project the handle 24 of the toner cartridge 8 out from the copier main body 1 by a predetermined amount.

A spring 65 is provided inside the rotating member 61 to urge the lever 60 in the direction of arrow B. Thus, when the user takes his or her hand off the gripping portion 63 with the lever 60 already rotated in the direction of arrow A, the lever 60 is rotated in the direction of arrow B to automatically return to its initial position.

Now, with reference to FIG. 15, description will be given of the structure of the vicinity of a toner receiver 73.

Figure 15:
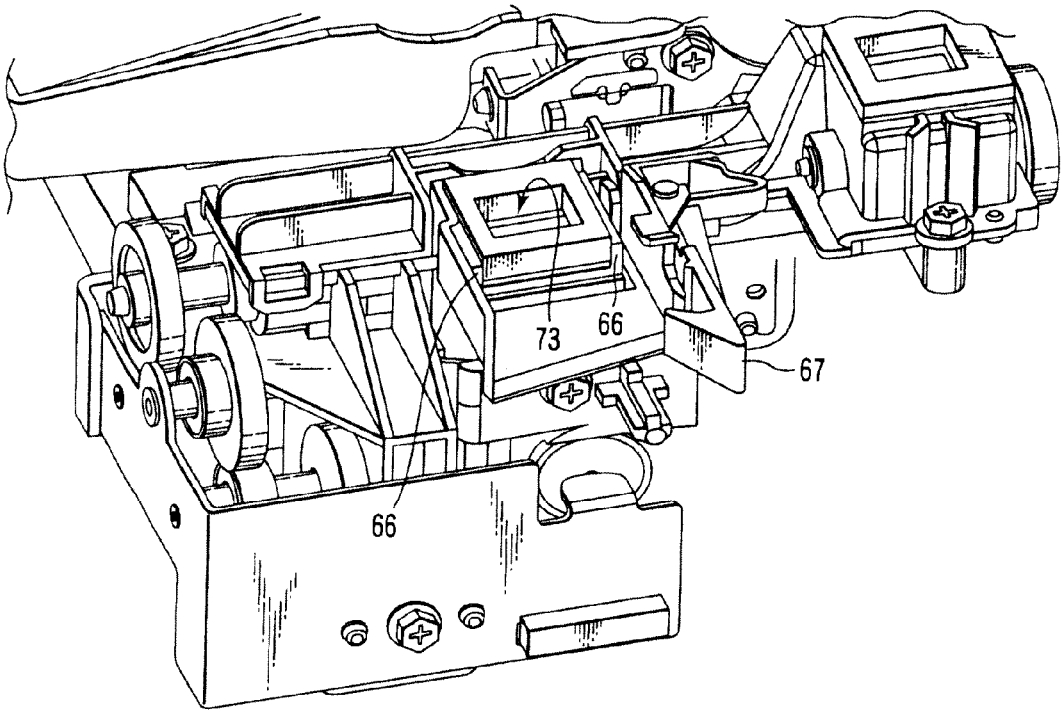
FIG. 15 is a perspective view showing the vicinity of a toner receiver according to the embodiment.

FIG. 15 is a perspective view showing the vicinity of the toner receiver 73 according to the embodiment.

As shown in FIG. 15, the toner receiver 73 is disposed at a position where it lies opposite the discharge port 13 when the toner cartridge 8 is installed in the copier main body 1, that is, below the discharge port 13; the toner receiver 73 is used to receive toner discharged from the discharge port 13 and feed it to the developing device 5.

The toner receiver 73 is formed to be slightly larger than the discharge port 13 in the toner cartridge main body 8*a*. In a plan view, the toner receiver 73 entirely contains the discharge port 13. Thus, toner discharged from the discharge port 13 is received by the toner receiver 73 without spillage.

Further, a first hook 66 is provided at a position where it lies opposite the shutter 14 when the toner cartridge 8 is inserted into the housing section 1B of the copier main body 1; the first hook 66 is used to open the discharge port 13. A second hook 67 is provided at a position where it lies opposite a side of the shutter 14 when the toner cartridge 8 is installed in the copier main body 1; the second hook 67 is used to close the discharge port 13.

Now, with reference to FIGS. 16 and 17, description will be given of an operation of using the shutter 14 to open and close the discharge port 13.

Figure 16:
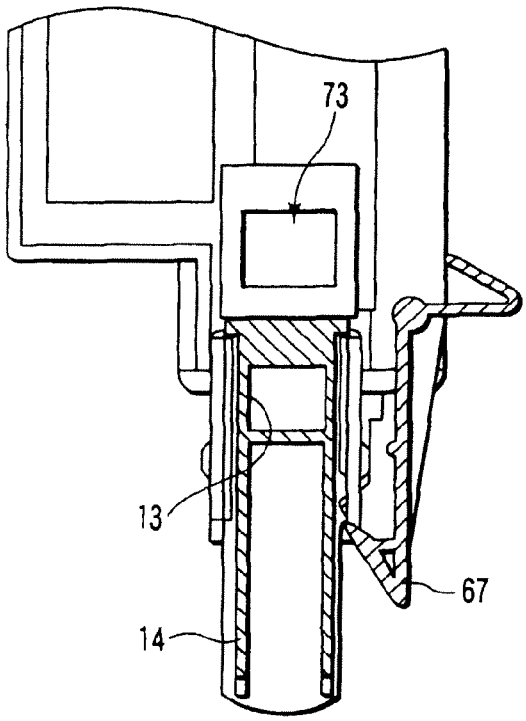
FIG. 16 is a schematic diagram showing a discharge port according to the embodiment in an open state.
Figure 17:
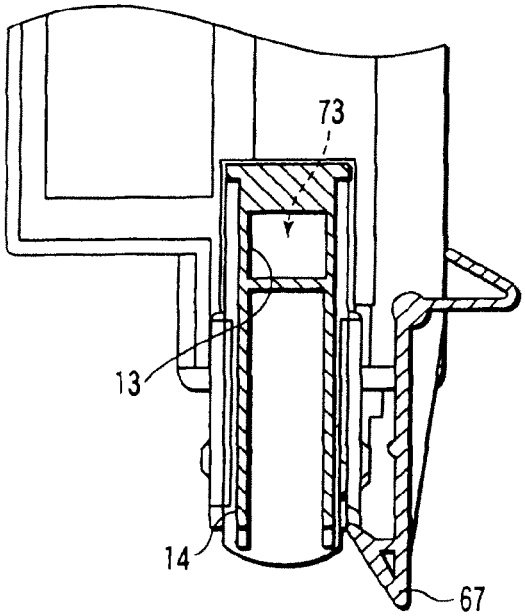
FIG. 17 is a schematic diagram showing the discharge port according to the embodiment in a closed state.

FIG. 16 is a schematic diagram showing the discharge port 13 according to the embodiment in an open state. FIG. 17 is a schematic diagram showing the discharge port 13 according to the embodiment in a closed state.

When the unused toner cartridge 8 is inserted into the copier main body 1, this motion causes the shutter 14 to be caught on the first hook 66. Only the shutter 14 is stopped at the first hook 66. Thus, as shown in FIG. 16, the shutter 14 moves from the position where it lies opposite the discharge port 13, to open the discharge port 13.

On the other hand, after the toner cartridge 8 is installed in the copier main body 1, the lever 60 is operated to project the handle 24 of the toner cartridge 8 out from the copier main body 1. This motion causes the shutter 14 to be caught on the second hook 67. Only the shutter 14 is stopped at the second hook 67. Thus, as shown in FIG. 17, the shutter 14 moves to the position where it lies opposite the discharge port 13, to close the discharge port 13. Subsequently, further pulling the toner cartridge 8 hard causes the hook 67 to come off the toner cartridge. The toner cartridge 8 can now be pulled out.

Now, a brief description will be given of an operation of replacing the toner cartridge 8 configured as described above.

When the toner in the toner cartridge main body 8*a* is exhausted after the toner has been supplied to the developing device 5, a cover (not shown) of the copier main body 1 is opened. Then, the lever 60 is rotated in the direction of arrow A. Thus, the pressing projection 64 of the lever 60 presses the pressed plate 25 to the front to project the handle 24, provided on the upper case 9*a*, out from the copier main body 1.

Then, fingers are placed on the handle 24, projecting out from the copier main body 1, to pull the toner cartridge 8 out from the copier main body 1. Instead, a new toner cartridge 8 is pushed from the first coupling member 12 into the housing section 1B of the copier main body 1 until it is completely housed in the housing section 1B.

The toner cartridge 8 taken out of the copier main body 1 is placed with its bottom surface up. Further, the unused toner cartridge 8 is stored with its bottom surface up.

In the cartridge 8 configured as described above, the plate-like handle 24 is provided on the front surface side of the top surface of the upper case 9, constituting the toner cartridge main body 8*a*, and extends in a substantially vertical direction. Thus, the toner cartridge 8 can be more easily pulled out from the housing section 1B of the copier main body 1. This makes it possible to improve operability in replacing the toner cartridge 8.

Furthermore, the plate-like pressed plate 25 is provided on the other side of the lower case 9*b* in its width direction, the lower case 9*b* constituting the toner cartridge main body 8*a*. The lever 60 is used to press the pressed plate 25 to the front to project the handle 24 out from the copier main body 1. This forms a gap between the housing section 1B of the copier main body 1 and the handle 24. As a result, the fingers can be more easily placed on the handle 24.

Further, the first hook 66 is provided at the position where it lies opposite the side of the shutter 14. Thus, when the toner cartridge 8 is pulled out from the housing section 1B of the copier main body 1, the first hook 66 catches the shutter 14 to close the discharge port 13.

Accordingly, when the toner cartridge 8 is removed, the discharge port 13 has already been closed. This prevents the unused toner in the toner cartridge 8*a* from being discharged from the discharge port 13 to contaminate the surroundings.

Moreover, the upper end 24*a* of the handle 24 is shaped like a substantially horizontal plane. Thus, when placed with its bottom surface up, the toner cartridge 8 can sit stably.

As a result, the user unconsciously places the toner cartridge 8 with its bottom surface up in order to lay it stably. This prevents the discharge port 13 from being directed downward when the unused toner cartridge 8 is stored. It is thus possible to prevent the toner in the toner cartridge main body 8*a* from being collected and congealed in the discharge port 13.

Further, the filling port 26 for toner filling is formed offset from the shaft member 15*c* of the mixer 15. Thus, when the toner cartridge main body 8*a* is filled with toner, the mixer 15 does not interfere with the operation. This makes it possible to reduce the time required for toner filling.

Moreover, the toner cartridge main body 8*a* is composed of the upper case 9*a* and the lower case 9*b*, with the parting surface 18 set above the vertical center of the toner cartridge main body 8*a*. Consequently, a large space is created below the parting surface 18 at the opposite end surfaces of the toner cartridge main body 8*a* in the longitudinal direction. The size of the filling port 26 can thus be increased. This also makes it possible to reduce the time required for toner filling.

Further, the sharp portion 22, consisting of the two resin plates, the first curvature portion 20*a* and turn-up portion 21, is formed on one side of the upper case 9*a* in its width direction. This increases the rigidity of the cartridge main body 8*a* in the longitudinal direction. Thus, it is difficult to deform the cartridge main body 8*a*, thus eliminating the difficulty in inserting and removing the toner cartridge 8 resulting from deformation of the toner cartridge main body 8*a*.

Furthermore, the axis of the shaft member 15*c* of the mixer is aligned with the center of curvature of the first curvature portion 20*a*. Moreover, the radius of curvature R1 of the first curvature portion 20*a* is slightly larger than the length a to the opposite ends of the plate-like truss structure portion 15*b* in its width direction as measured from the center of the shaft member 15*c* of the mixer 15.

Accordingly, when the mixer 15 is rotated in the toner cartridge main body 8*a*, the plate-like truss structure portion 15*a* moves along the inner peripheral surface of the first curvature portion 20*a* so as to graze this inner peripheral surface.

This allows the toner present near the inner peripheral surface of the first curvature portion 20*a* to be appropriately scraped out. It is thus possible to reduce the amount of toner remaining when the toner cartridge 8 is replaced.

Moreover, the second curvature $\kappa 2$ of the second curvature portion 20*b* of the upper case 9*a* is smaller than the first curvature $\kappa 1$ of the first curvature portion 20*a*. Thus, the inner space of the toner cartridge 8 is enlarged to enable more toner to be accommodated. This makes it possible to reduce the number of times that the toner cartridge 8 is replaced and thus reduce the maintenance costs of the electrophotographic copier.

Moreover, the toner cartridge main body 8*a* is composed of the upper case 9*a* and the lower case 9*b*, with the parting surface 18 set above the vertical center of the toner cartridge main body 8*a*. Consequently, when supported using the ribs 19, the toner cartridge main body 8*a* sits stably.

The present invention is not limited to the above embodiments. In implementation, the components of the embodiments may be varied without departing from the spirit of the present invention. Various inventions can be formed by appropriately combining a plurality of the components disclosed in the above embodiments. For example, some of the components shown in the embodiments may be omitted. Moreover, components from different embodiments may be appropriately combined.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A toner container comprising:

a toner container main body including a predetermined length and including an upper case and a lower case and in which toner is accommodated, wherein the upper case includes a first curvature portion bent at a first curvature and a second curvature portion facing the first curvature portion and bent at a second curvature, and wherein the second curvature is larger than the first curvature;

a discharge port formed on the lower case through which the toner is discharged from the toner container main body;

a screw provided in the toner container main body to convey the toner to the discharge port, the screw being located closer to the first curvature portion than to the second curvature portion;

a mixer which stirs the toner in the toner container main body; and a handle formed on a front portion of the toner container main body, wherein the handle has a flat upper end and is formed at substantially the same height from the first curvature portion to the second curvature portion.

2. The toner container of claim 1, wherein the handle projects in a longitudinal direction of the toner container main body.

3. The toner container of claim 2, wherein the handle is formed along a width direction of the toner container main body.

4. The toner container of claim 1, wherein the mixer is configured to move along an inner peripheral surface of the first curvature portion.

5. A toner container comprising:

a toner container main body including a predetermined length and including an upper case and a lower case and in which toner is accommodated, wherein the upper case includes a first curvature portion bent at a first curvature and a second curvature portion facing the first curvature portion and bent at a second curvature, and wherein the second curvature is larger than the first curvature, the lower case including a third curvature portion bent at a same curvature as the first curvature portion;

a discharge port formed on the lower case through which the toner is discharged from the toner container main body;

a screw provided in the toner container main body to convey the toner to the discharge port, the screw being located closer to the first curvature portion than to the second curvature portion;

a mixer which stirs the toner in the toner container main body, the mixer configured to move along an inner peripheral surface of the first curvature portion; and a handle formed on a front portion of the toner container main body.

6. The toner container of claim 5, wherein the handle has a flat upper end.

* * * * *